United States Patent [19]

Fraenkel

[11] 4,175,709

[45] Nov. 27, 1979

[54] METHOD AND APPARATUS FOR SEPARATING FIBERS FROM AGGLOMERATED MASSES THEREOF

[75] Inventor: Stephen J. Fraenkel, Winnetka, Ill.

[73] Assignee: Container Corporation of America, Chicago, Ill.

[21] Appl. No.: 888,233

[22] Filed: Mar. 20, 1978

[51] Int. Cl.[2] ..... B02C 4/30

[52] U.S. Cl. ..... 241/21; 241/28; 241/102; 241/159; 241/235; 241/DIG. 30

[58] Field of Search ..... 241/27, 28, 102, 105, 241/106, 159, 234, 235, 21, 30, DIG. 30

[56] References Cited

U.S. PATENT DOCUMENTS

| | | | |
|---|---|---|---|
| 1,827,279 | 10/1931 | Carnahan | 241/102 X |
| 2,094,083 | 9/1937 | Rey | 241/235 X |
| 2,195,754 | 4/1940 | Robson et al. | 241/DIG. 30 |
| 2,610,634 | 9/1952 | Beck et al. | 241/DIG. 30 |

*Primary Examiner*—Mark Rosenbaum

*Attorney, Agent, or Firm*—Carpenter & Ostis

[57] ABSTRACT

Method and apparatus for separating fibers from agglomerated masses thereof is disclosed, and achieved by paired rolls having roll surfaces with randomly disposed protuberances thereon, such protuberances being initially deformed randomly as the roll surfaces approach complete conjugacy and being further deformed as the roll surfaces move into complete conjugacy to induce shearing and tearing action on the agglomerated fiber masses therebetween to separate discrete fibers therefrom. The roll surfaces are characterized by each having the elastomeric roll surface thereof with a Poisson ratio different from the Poisson ratio of the other.

10 Claims, 9 Drawing Figures

METHOD AND APPARATUS FOR SEPARATING FIBERS FROM AGGLOMERATED MASSES THEREOF

BACKGROUND OF THE INVENTION

The invention herein has for its principal purpose the separation of discrete fibers from agglomerated masses thereof such as may result, for example, from the processes for making pulp in paper mills or the like.

SUMMARY OF THE INVENTION

The primary purpose of the present invention is to provide a method of treating agglomerated fiber masses to separate discrete fiber therefrom. Employment of the invention structure and method is indicated in the further treatment of pulpwood which has undergone the usual steps to provide agglomerated masses of fibers needing further separation to make paper.

THE DRAWINGS

Figure 1:
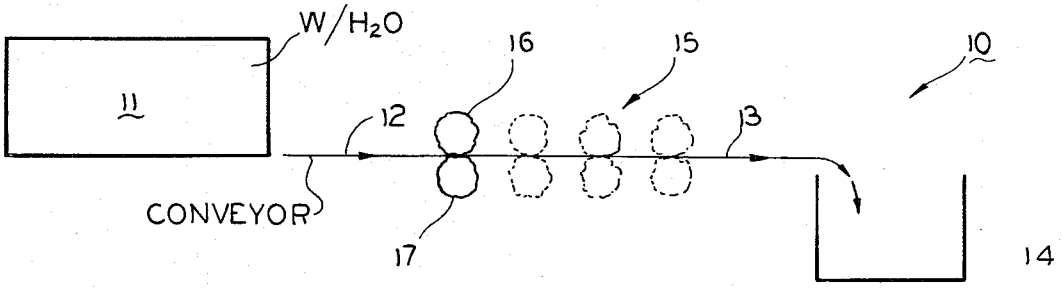
FIG. 1 is a flow diagram illustrating an environment in which the invention may be employed.
Figure 2:
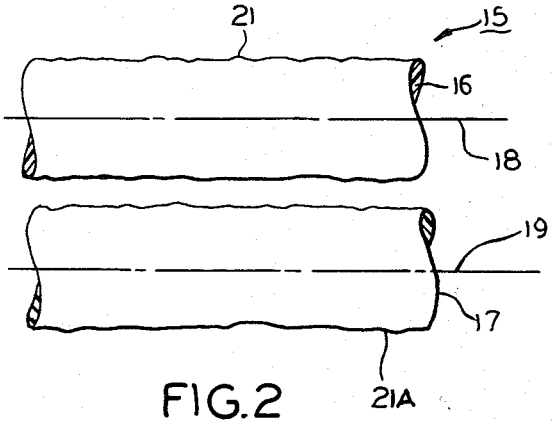
FIG. 2 is an elevational view of a pair of rolls for acting upon agglomerated fiber masses for separating therefrom discrete fibers.
Figure 3:
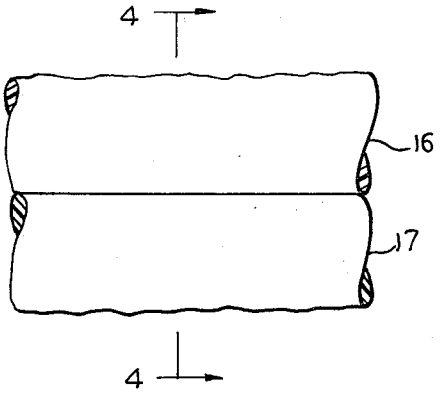
FIG. 3 is an elevational view showing the rolls of FIG. 2 in conjugacy.
Figure 4:
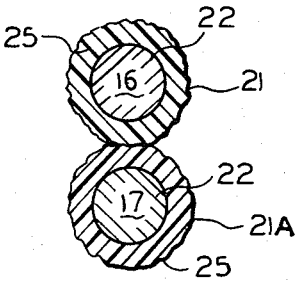
FIG. 4 is a transverse section through the rolls of FIG. 3 looking in the direction of the arrows 4—4 thereof.

The apparatus according to the present invention and the method carried on thereby is referred to generally by the reference numeral 10 and includes a supply 11 of agglomerated fibrous material preferably in a water suspension thereof. A supply conveyor 12 conveys the material into a roll array 15, and an exit conveyor 13 conveys the treated material into a storage receptacle 14.

The roll array 15 comprises a plurality of conjugately arranged roll pairs 16 and 17 mounted to rotate on respective axes 18 and 19. Each roll has a core 22 supporting a covering 25 of substantial thickness, the surface of which has randomly arranged protuberances 21 and 21A formed thereon.

The material of the coverings is an elastomer of suitable properties, and the property of the covering of one roll is preferably different from the property of the covering of the other roll. Each roll is selected with material of a desirable Poisson ratio, roll surface of roll 16, for example having a Poisson ratio of 0.5, and the roll surface of roll 17 having a Poisson ratio of 0.4.

Figure 5:
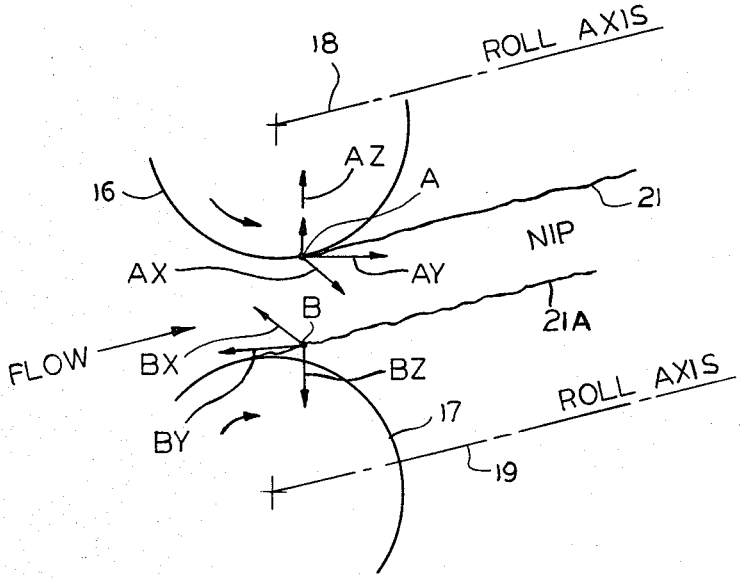
FIG. 5 is a vector diagram illustrating the force vectors acting upon the fibers as they are caught in the nip of the rolls of FIGS. 2 and 3 to separate the fibers into discrete fibers.

As the roll surfaces are in conjugacy, as seen in FIG. 5, reaction vectors at point A of conjugacy on roll 16 are labeled Ax, Ay and Az, and reaction vectors at an opposite conjugate point B on roll 17 are labeled Bx, By and Bz.

Figure 6:
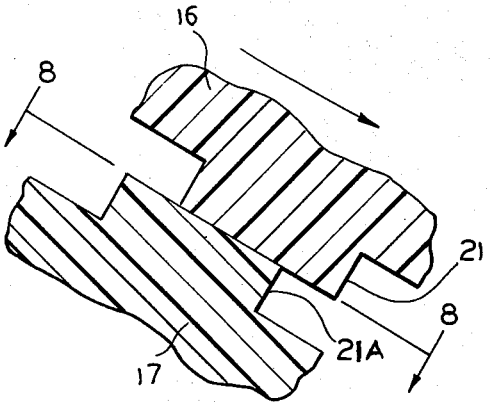
FIG. 6 is a transverse sectional view through the rolls of FIGS. 2 and 3 as they approach conjugacy and trap a mass of fibers therebetween.
Figure 8:
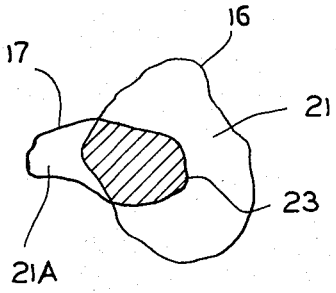
FIG. 8 is a view taken along the line 8—8 looking in the direction of the arrows of FIG. 6 showing the initial deformation of the roll surfaces as contact is made by the protuberances thereon.
Figure 9:
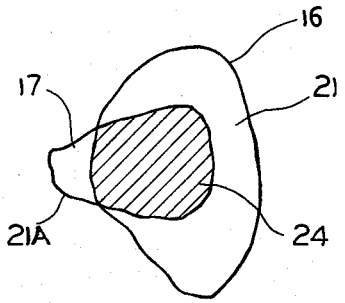
FIG. 9 is a view taken along the line 9—9 looking in the direction of the arrows of FIG. 7 showing the increased deformation of the roll protuberances when the surfaces are in conjugacy.

Such reactions give rise to deformation near where the rolls approach initial conjugacy and to increased deformation at the point of complete conjugacy. The initial deformation takes place as seen in FIG. 6. The protuberance 21 of the roll 16 has a larger deformation than protuberance 21A of the roll 17 with the area of contact between the protuberances 21, 21A being shown as the shaded area 23 in FIG. 8.

Figure 7:
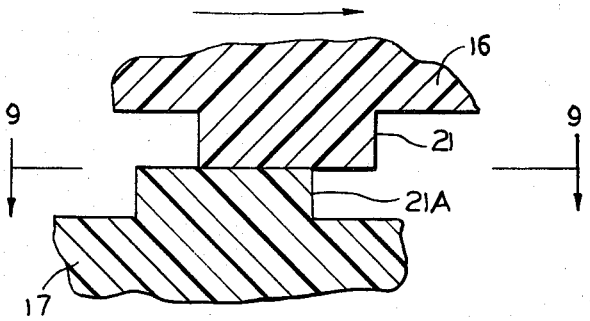
FIG. 7 is a view similar to FIG. 6 showing the rolls in conjugacy.

As the same protuberances deform further, as seen in FIG. 7, where protuberances 21, 21A are in complete conjugacy, the area of contact is denoted by the increased shaded area 24.

Such increase in the areas of contact creates a shearing force between the protuberances of the rolls 16 and 17, which force causes the agglomerated fiber masses to separate into discrete fibers.

It may be noted that a number of roll pairs may be provided in the roll array to complete the fiber separation.

In order to provide the desirable differences in Poisson's ratios of the rolls 16 and 17, the durometers of the elastomeric covering material 25 are varied accordingly.

I claim:

1. In an apparatus for separating fibers from an agglomerated mass thereof:

(a) at least one pair of rolls having roll surfaces of elastomeric material and arranged to rotate along roll axes to cause said surfaces to move into conjugacy and engage the fiber masses in the nip of said rolls;

(b) each of said rolls having randomly dispersed protuberances thereon which are distorted in random fashion as the roll surfaces move into conjugacy;

(c) said protuberances having initial deformations existing prior to the protuberances moving into conjugacy and being caused by the presence of masses of said fibers;

(d) said protuberances having further deformations causing slipping between the surfaces of the protuberances as they undergo further deformation by the movement into conjugacy to induce shearing and tearing action of said fiber masses and to separate discrete fibers from said masses.

2. In the apparatus according to claim 1, wherein said protuberances have displacements laterally of a plane common to the axes of rotation of said rolls and a plane transverse to said first named plane.

3. In the apparatus according to claim 1, wherein the elastomeric material of one roll surface has a different durometer from the roll surface of the other roll.

4. In the apparatus according to claim 1, wherein the Poisson ratio of one roll surface is different from the Poisson ratio of the other roll surface.

5. In the apparatus according to claim 3, wherein the slipping between the surfaces as they approach conjugacy is increased by the difference in durometers of the roll surfaces.

6. In the apparatus according to claim 4, wherein the slipping is increased by the difference in Poisson ratios of the roll surfaces.

7. In an apparatus for separating fibers from an agglomerated mass thereof:

(a) means for supplying a suspension in liquid of agglomerated masses of said fibers;

(b) means for conveying masses of said agglomerated fibers to at least one pair of rolls for separating discrete fibers from agglomerated masses thereof;

(c) each pair of rolls having roll surfaces of elastomeric material and being arranged to rotate along roll axes to cause said surfaces to move into conjugacy and engage the fiber masses in the nip of said rolls;

(d) each of said rolls having randomly dispersed protuberances thereon which are distorted in random fashion as the roll surfaces move into conjugacy;

(e) said protuberances having initial deformations existing prior to the protuberances moving into conjugacy and by the presence of agglomerated masses of said fibers;

(f) said protuberances having further deformations causing slipping between the surfaces of the protuberances as they undergo further deformation by movement into conjugacy to induce shearing and tearing action of said fiber masses and to separate discrete fibers from said masses;

(g) means for conveying said separated fibers from said rolls.

8. In a method for separating fibers from an agglomerated mass thereof, the steps of:

(a) providing at least one pair of rolls having roll surfaces of elastomeric material arranged to rotate along roll axes to cause said surfaces to move into conjugacy and engage the fiber masses in the nip of said rolls;

(b) providing each of said rolls with randomly dispersed protuberances thereon which are distorted in random fashion as the roll surfaces move into conjugacy;

(c) causing said protuberances to have initial deformations thereon to exist prior to the movement of said protuberances into conjugacy and caused by the presence of masses of said fibers;

(d) providing said protuberances with further deformations to cause slipping between the surfaces of the protuberances as they undergo further deformation by movement in conjugacy to induce shearing and tearing action of said fiber masses and to separate discrete fibers from said masses.

9. In a method according to claim 8, to provide said protuberances with displacements laterally of a plane common to the axes of rotation of said rolls and a plane transverse to said first named plane.

10. In a method according to claim 8, to provide the elastomeric material of one roll surface with a different durometer from the roll surface of the other roll.

* * * * *